US011075044B2

(12) United States Patent
Lin et al.

(10) Patent No.: US 11,075,044 B2
(45) Date of Patent: Jul. 27, 2021

(54) ELECTROMAGNETIC RELAY

(71) Applicant: Xiamen Hongfa Signal Electronics Co., Ltd., Xiamen (CN)

(72) Inventors: Jiabin Lin, Xiamen (CN); Qiyue Guo, Xiamen (CN); Zhikun Wang, Quanzhou (CN)

(73) Assignee: XIAMEN HONGFA SIGNAL ELECTRONICS CO., LTD., Xiamen (CN)

( * ) Notice: Subject to any disclaimer, the term of this patent is extended or adjusted under 35 U.S.C. 154(b) by 302 days.

(21) Appl. No.: 16/321,986

(22) PCT Filed: Aug. 9, 2017

(86) PCT No.: PCT/CN2017/096675

§ 371 (c)(1),
(2) Date: Jan. 30, 2019

(87) PCT Pub. No.: WO2018/040872

PCT Pub. Date: Mar. 8, 2018

(65) Prior Publication Data

US 2019/0180964 A1 Jun. 13, 2019

(30) Foreign Application Priority Data

Aug. 29, 2016 (CN) ..... 201610755861.X

(51) Int. Cl.
*H01H 50/36* (2006.01)
*H01H 50/18* (2006.01)
*H01H 50/44* (2006.01)

(52) U.S. Cl.
CPC ..... *H01H 50/36* (2013.01); *H01H 50/18* (2013.01); *H01H 50/44* (2013.01)

(58) Field of Classification Search
CPC ..... H01H 50/18; H01H 50/44; H01H 50/36
See application file for complete search history.

(56) References Cited

U.S. PATENT DOCUMENTS

2017/0047182 A1 2/2017 Kubono

FOREIGN PATENT DOCUMENTS

CN 201117581 Y 9/2008
CN 201311887 Y 9/2009
CN 105047483 A 11/2015
(Continued)

OTHER PUBLICATIONS

First Office Action for Indian Application No. 201917005850 dated Feb. 3, 2020.

(Continued)

*Primary Examiner* — Mohamad A Musleh
(74) *Attorney, Agent, or Firm* — Renner, Otto, Boisselle & Sklar, LLP

(57) ABSTRACT

An electromagnetic relay includes a movable contact piece, a yoke, and a coil, the coil being provided with an iron core, wherein the yoke is L-shaped, and has a horizontal edge and a vertical edge; the yoke is disposed outside the coil, and the horizontal edge of the yoke is fixedly connected to the bottom of the iron core, and the vertical edge of the yoke is parallel to an axis of the iron core, wherein one side of the vertical edge of the yoke facing to the coil is provided with a plastic layer formed by means of injection molding, the plastic layer is provided between the yoke and the coil in an insulating manner.

14 Claims, 7 Drawing Sheets

(56) References Cited

FOREIGN PATENT DOCUMENTS

| | | | |
|---|---|---|---|
| CN | 106206166 | A | 12/2016 |
| CN | 206003705 | U | 3/2017 |
| JP | H03246846 | A | 11/1991 |
| JP | H07106120 | A | 4/1995 |
| JP | 2009009710 | A | 1/2009 |
| JP | 2013196763 | A | 9/2013 |
| JP | 2016015296 | A | 1/2016 |
| WO | 2016002558 | A1 | 1/2016 |

OTHER PUBLICATIONS

First Office Action for Corresponding Japanese Application No. 2019529310.

First Office Action for corresponding Chinese Application No. 201610755861.X dated Nov. 1, 2017.

International Search Report and Written Opinion for corresponding International Application No. PCT/CN2017/096675 dated Nov. 13, 2017, with English translation of International Search Report.

ELECTROMAGNETIC RELAY

CROSS-REFERENCES TO RELATED APPLICATIONS

The present disclosure is based on International Application No. PCT/CN2017/096675, filed on Aug. 9, 2017, which is based upon and claims priority to Chinese Patent Application No. CN201610755861.X, titled "Electromagnetic Relay", and filed on Aug. 29, 2016, and the entire contents thereof are incorporated herein by reference.

TECHNICAL FIELD

The present disclosure relates to a technical field of electronic components, in particular to an electromagnetic relay.

BACKGROUND

FIG. 1 is a schematic view of an electromagnetic relay, which is also a classical structure widely used in a relay industry. The electromagnetic relay includes a movable contact piece 101, a yoke 102, a coil 103, and an armature 104, wherein the yoke 102 is L-shaped, a horizontal edge of yoke 102 is secured to the iron core on the bottom of the coil 103; a vertical edge of yoke 102 is parallel to an axis of iron core. The movable contact piece 101 and the armature 104 are assembled to form a movable contact piece armature assembly. The yoke 102 is provided with a protrusion 1021. The movable contact piece 101 is provided with an aperture. The aperture of the movable contact piece 101 is matched with the protrusion 1021 of the yoke 102. The armature 104 is provided at a blade edge, that is, at the top of the vertical edge of the yoke 102. The movable contact piece armature assembly is secured to the yoke 102 in a riveting manner. Such electromagnetic relay mainly has drawbacks below: there is insufficient insulation (i.e., a creep distance) between the yoke and the coil (i.e., the enamelled wire).

To solve the above problems, two methods are employed in the prior art: one method is to wrap the outer surface of the coil (i.e., the enamelled wire) by an adhesive tape to increase insulation between the coil (i.e., the enamelled wire) and the yoke. However, this method not only adds an additional process, but also has a risk of breakage of the enamelled wire. The other method is to insert an insulating tape or a plastic sheet between the coil and the yoke.

FIG. 2 is a schematic view showing a plastic sheet is put into the electromagnetic relay in the prior art. As shown in FIG. 2, a plastic sheet 105 is placed between the yoke 102 and the coil 103, in order to improve the insulation between the coil (i.e., the enameled wire) and the yoke. However, the method not only adds an additional process, but also increases difficulty for assembling. It is difficult to enclose the enameled wire completely by the insulation tape as wrapping, or the plastic sheet is not completely fixed, as a result, it is easy to shake during use or transportation, and it is difficult to ensure an insulation effect. Moreover, it is required to reserve an assembling space, which may affect the winding space of the enameled wire, and thereby not helpful to improve the performance of the product.

It should be noted that the Background portion contains the above-described information which are merely used to reinforce understanding of the background technology of the present disclosure, and thus may include information that does not constitute the prior art as already known by an ordinary person skilled in the art.

SUMMARY

According to an aspect of the present disclosure, an electromagnetic relay includes a movable contact piece, a yoke, and a coil, the coil being provided with an iron core, wherein the yoke is L-shaped, and has a horizontal edge and a vertical edge; the yoke is disposed outside the coil, and the horizontal edge of the yoke is fixedly connected to the bottom of the iron core, and the vertical edge of the yoke is parallel to an axis of the iron core, wherein one side of the vertical edge of the yoke facing to the coil is provided with a plastic layer formed by means of injection molding, the plastic layer is provided between the yoke and the coil in an insulating manner.

According to one implementation of the present disclosure, one side of the vertical edge of the yoke facing away from the coil is provided with a plastic protrusion formed by means of the injection molding, the plastic protrusion is fixedly connected to the movable contact piece.

According to one implementation of the present disclosure, the vertical edge of the yoke is provided with a first through hole corresponding to the plastic protrusion, and the first through hole is provided with a first plastic body formed by means of the injection molding.

According to one implementation of the present disclosure, a plastic gate of the plastic layer, the plastic protrusion and the plastic body during injection molding is located on the plastic protrusion.

According to one implementation of the present disclosure, a shape of the first through hole of the yoke is a circle, a square, a triangle, an ellipse or a rectangle.

According to one implementation of the present disclosure, one side of the vertical edge of the yoke facing to the coil is further provided with a groove, into which the plastic layer is filled.

According to one implementation of the present disclosure, one side of the plastic layer facing the coil is flush with one side of the vertical edge of the yoke facing the coil.

According to one implementation of the present disclosure, one side of the plastic layer facing to the coil protrudes from one side of the vertical edge of the yoke facing to the coil, and the protruding portion has a thickness that is not more than 0.4 mm.

According to one implementation of the present disclosure, a height of the plastic layer exceeds a size of the winding window of the bobbin of the coil in a vertical direction.

According to one implementation of the present disclosure, the movable contact piece is provided with a second through hole corresponding to the first through hole of the yoke, and the plastic protrusion of the yoke is fitted into the second through hole of the movable contact piece such that the movable contact piece is fixedly connected to the yoke.

According to one implementation of the present disclosure, the plastic protrusion is formed by means of the injection molding and protrudes from the second through hole of the movable contact piece; and a fixing portion is formed on an bottom end of the plastic protrusion protruding from the second through hole of the movable contact piece has a cross-sectional area larger than the second through hole of the movable contact piece, to wholly or partially cover the movable contact piece around the second through hole of the movable contact piece, such that the movable contact piece is fixedly connected to the yoke.

According to one implementation of the present disclosure, the plastic protrusion is inserted into and protruded from the second through hole of the movable contact piece, by hot-riveting the plastic protrusion protruding from the second through hole of the movable contact piece, the plastic protrusion is deformed to extend outwardly to form an extending portion, and the extending portion completely or partially covers the movable contact piece around the second through hole of the movable contact piece, to fix the movable contact piece and the yoke.

According to one implementation of the present disclosure, a molten structure formed by a laser welding is further provided at a point where the movable contact piece is in contact with the yoke, and the movable contact piece is integrally connected to the yoke by means of the molten structure.

According to one implementation of the present disclosure, the molten structure is dot-shaped, and a plurality of dot-shaped molten structures are arranged in a straight line.

According to one implementation of the present disclosure, the molten structure is in a linear shape.

The present disclosure is further described in detail below with reference to the accompanying drawings and embodiments. However, the electromagnetic relay of the present disclosure is not limited to the embodiments.

Figure 1:
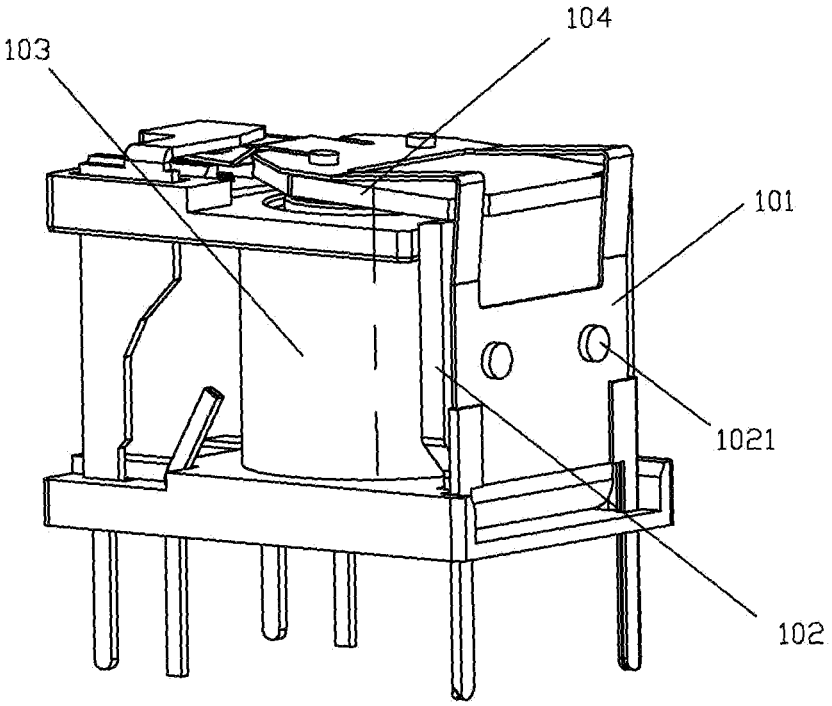
Fig.1(Prior Art )
FIG. 1 is a schematic view of an electromagnetic relay in the prior art.
Figure 2:
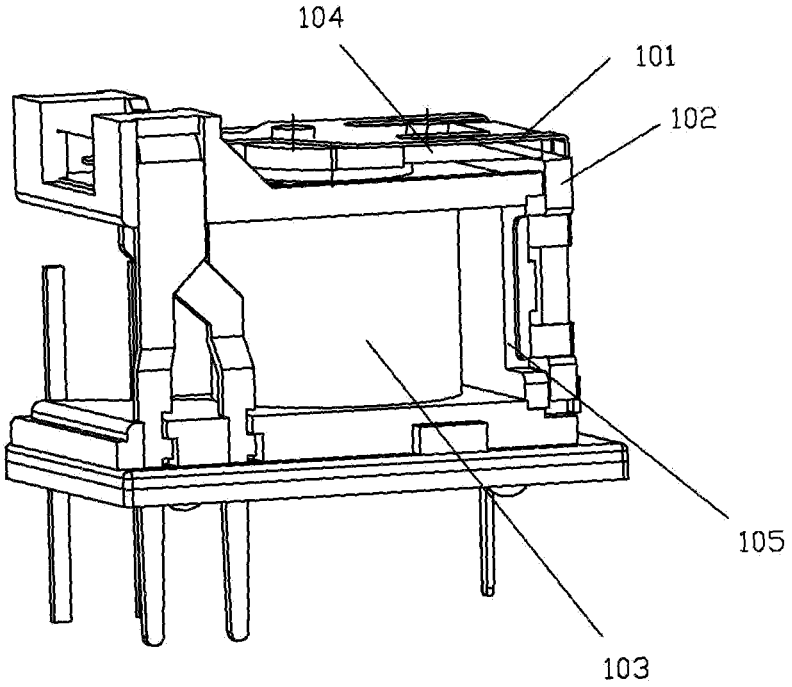
Fig.2(Prior Art )
FIG. 2 is a schematic view of the electromagnetic relay inserted by a plastic sheet in the prior art.
Figure 3:
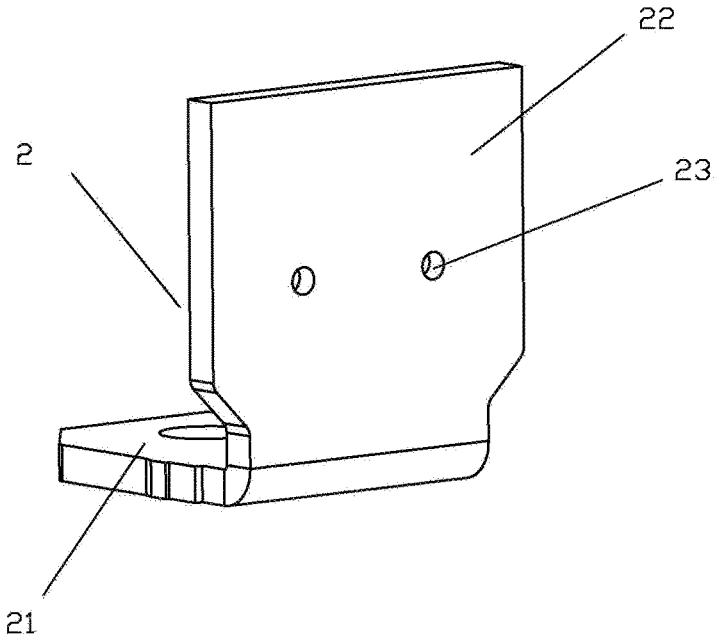
FIG. 3 is a schematic perspective view of the yoke prior to an injection molding according to the first embodiment of the electromagnetic relay of the present disclosure.
Figure 4:
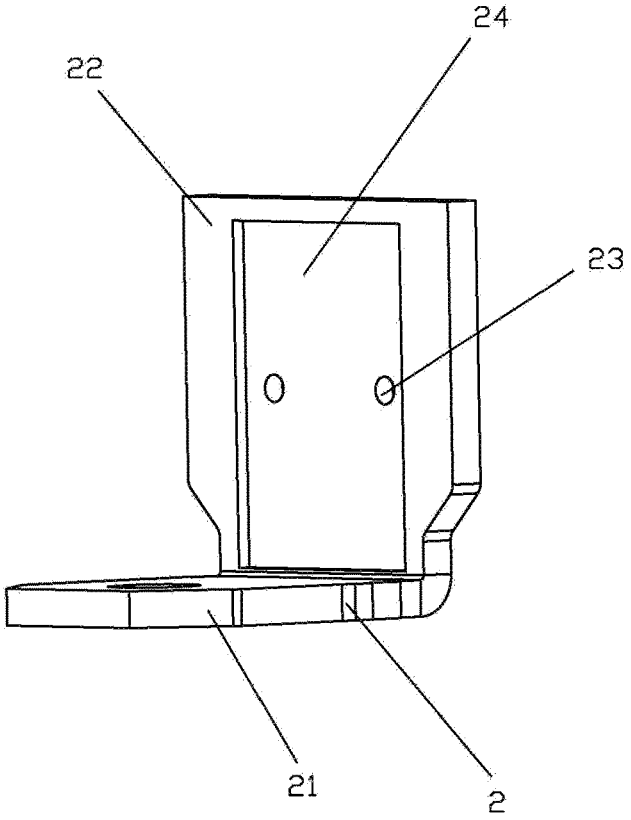
FIG. 4 is a schematic perspective view of the yoke as shown in FIG. 3 observed from another view.
Figure 5:
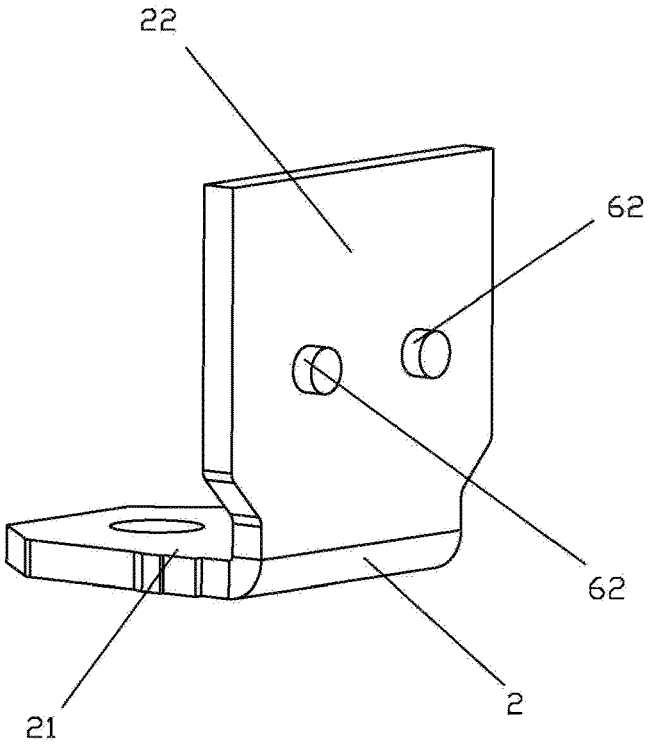
FIG. 5 is a perspective view of the yoke as shown in FIG. 3 after injection molding.
Figure 6:
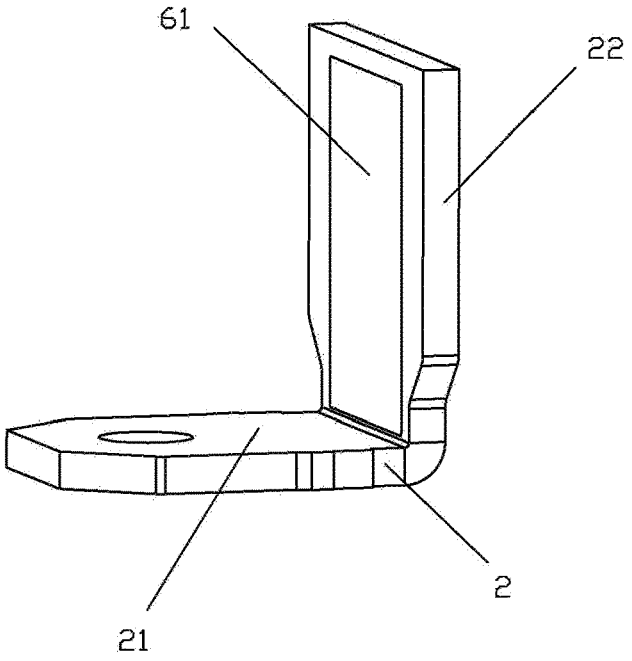
FIG. 6 is a schematic perspective view of the yoke as shown in FIG. 5 observed from another view.
Figure 7:
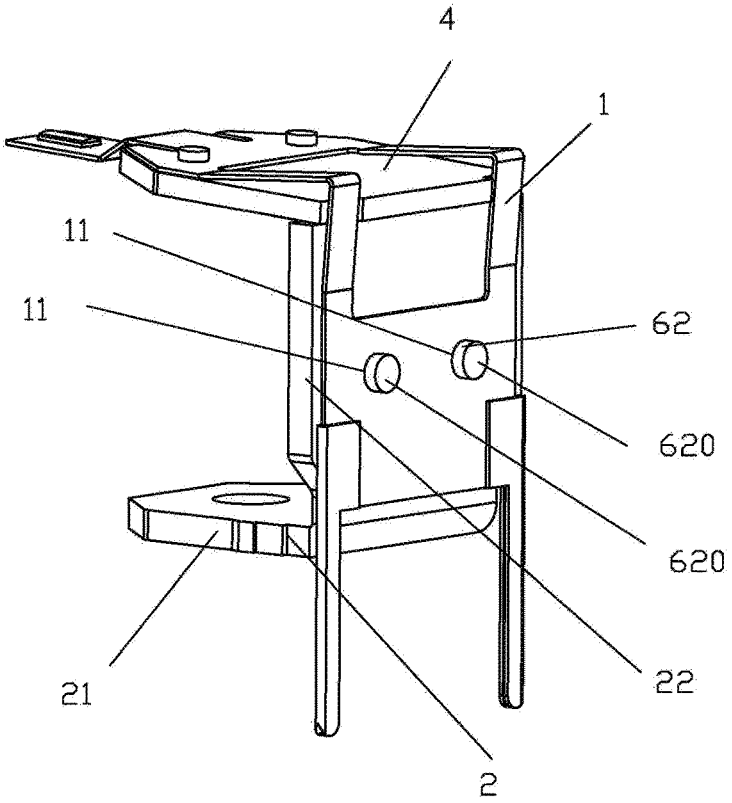
FIG. 7 is a perspective view of injection molding of the yoke and movable contact piece armature assembly as shown in FIG. 5.
Figure 8:
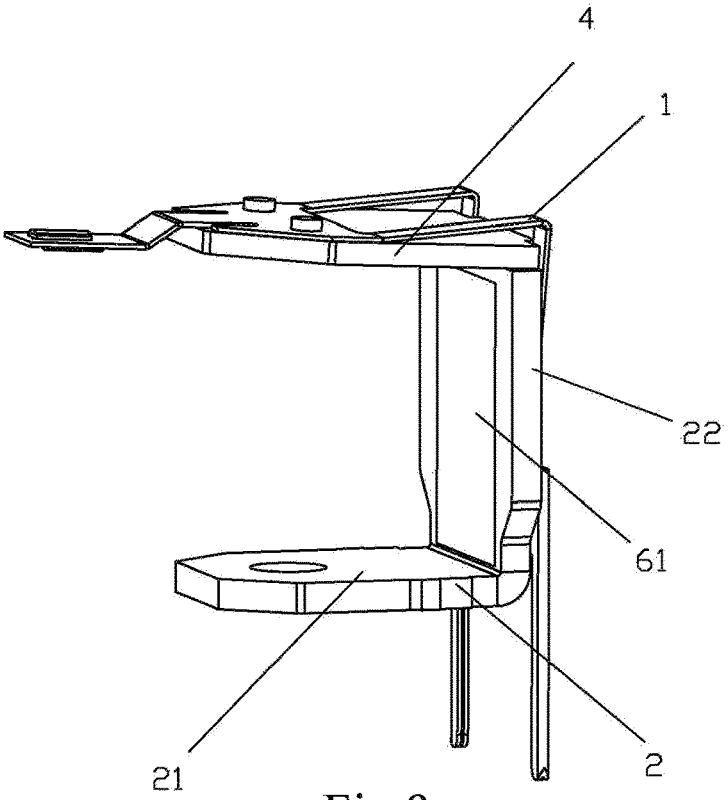
FIG. 8 is a perspective view of the yoke and movable contact piece armature assembly as shown in FIG. 7 observed from another view.
Figure 9:
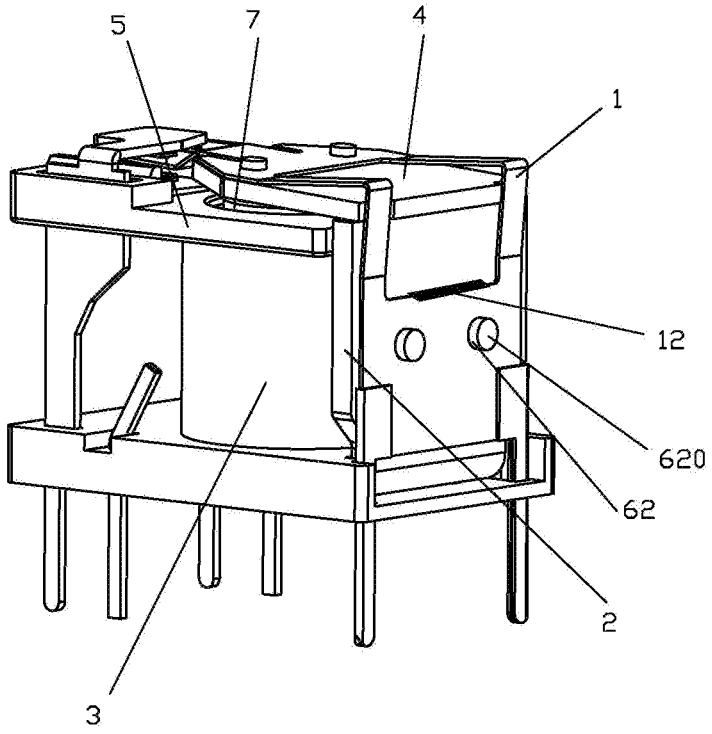
FIG. 9 is a schematic perspective view of the first implementation of the electromagnetic relay of the present disclosure.
Figure 10:
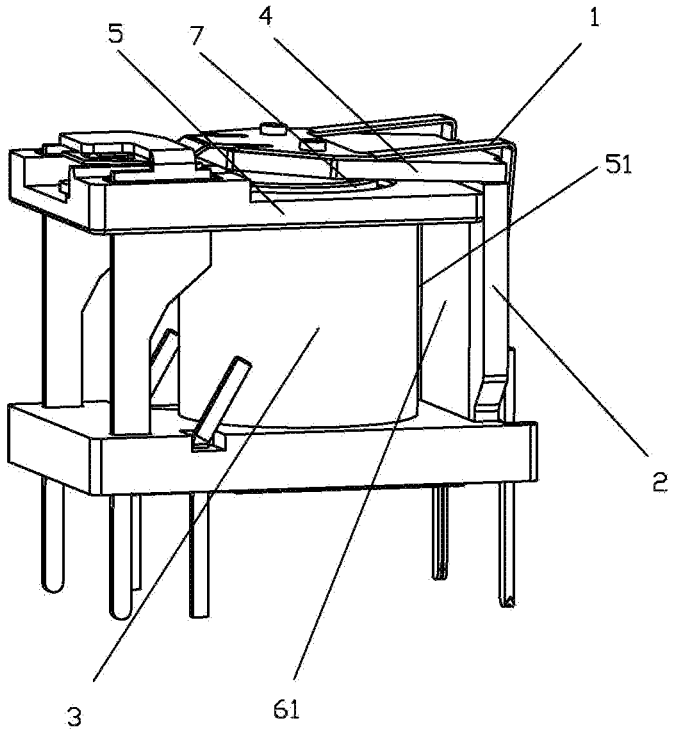
FIG. 10 is a schematic perspective view of the electromagnetic relay as shown in FIG. 9 observed from another view.

In which, 1. movable contact piece; 11. second through hole; 12. molten structure; 2. yoke; 21. horizontal edge; 22. vertical edge; 23. first through hole; 24. groove; 3. coil; 4. armature; 5. bobbin; 61. plastic layer; 62. plastic protrusion; 620. fixing portion; 621. extending portion; 7. iron core.

DETAILED DESCRIPTION

Now, the exemplary embodiments will be described more fully with reference to the accompany drawings. However, the exemplary embodiments can be implemented in various forms and should not be construed as limited to the embodiments set forth herein. Instead, these embodiments are provided so that the present disclosure will be thorough and complete, and the concept of the exemplary embodiment will fully conveyed to those skilled in the art. Same reference signs denote the same or similar structures in the accompany drawings, and thus the detailed description thereof will be omitted.

An object of the present disclosure is to overcome the short comings of the prior art, and thereby provides an electromagnetic relay, which can, through improvement of a yoke and connection structure between the yoke and a movable contact piece, improve insulation performance between the yoke and the coil and effectively reduce assembling process without affecting a winding space.

The First Embodiment

Referring to FIG. 3 to FIG. 10, an electromagnetic relay according to the first implementation of the present disclosure includes a movable contact piece 1, a yoke 2, a coil 3, an armature 4, and a bobbin 5. The bobbin 5 has a through hole that is arranged vertically. An iron core 7 is received in the through hole. The coil 3, for example, an enamelled wire is arranged surrounding the bobbin 5. The movable contact piece 1 and the armature 4 are assembled together to form a movable contact piece armature assembly. The yoke 2 is L-shaped and has a horizontal edge 21 and a vertical edge 22. The yoke 2 is provided outside the coil 3. The horizontal edge 21 of yoke is fixedly connected to the bottom of the iron core 7 in the coil 3, and a vertical edge 22 of the yoke 2 is parallel to an axis of iron core 7. One side of the vertical edge 22 of the yoke 2 facing towards the coil 3 is provided with a plastic layer 61 formed by means of injection molding, such that an additional insulation layer is formed between the yoke 2 and the coil 3. On side of the plastic layer 61 facing away from the coil 3 is provided with at least one plastic protrusion 62 formed by means of injection molding, such that the plastic layer 61 is fixedly connected to the movable contact piece 1 by the plastic protrusion 62. Two plastic protrusions 62 are provided in this embodiment.

The vertical edge 22 of the yoke 2 is provided with a first through hole 23 corresponding to the position of the plastic protrusion 62, and a first plastic body (not shown) formed by means of injection molding is provided in the first through hole 23.

In this embodiment, the first through hole 23 of the yoke 2 is circular, of course, the first through hole 23 may be designed to be a square, a triangle, an ellipse, a rectangle, or the other shapes as desired.

In the vertical edge 22 of the yoke 2, a groove 24 is further provided on the side facing to the coil 3, and the plastic layer 61 is filled in the groove 24.

In this embodiment, one side of the plastic layer 61 facing to the coil 3 is flush with one side of the vertical edge 22 of the yoke 2 facing to the coil 3, that is to say, the plastic layer 61 just fills in the groove 24 without protruding out of the plane of one side of the vertical edge 22 of the yoke 2 facing toward the coil 3.

Of course, if the product space is sufficient, one side of the plastic layer 61 facing to the coil 3 may be designed to protrude out of the side of the vertical edge 22 of the yoke 2 facing to the coil 3, and the thickness of the protruding portion usually does not exceed 0.4 mm. In the present disclosure, the thickness of the protruding portion of the plastic layer 61 is set to less than 0.4 mm because the plastic layer of 0.4 mm may achieve the insulating effect. The plastic layer is too thick to save the material and also take up the winding space. At this time, it is also possible to remove the groove 24, but form a plastic layer 61 by means of injection molding directly on the side of the vertical edge 22 of the yoke 2 facing to the coil.

A height of the plastic layer 61 exceeds the dimension of a winding window 51 of the bobbin 5 in a vertical direction, and a width of the plastic layer 61 may be appropriately extended to both sides, to increase an insulation distance. The width of the plastic layer 61 may be designed according to actual insulation requirements for the product.

The movable contact piece 1 is provided with a second through hole 11 corresponding to the position of the first through hole 23 of the yoke, such that the plastic protrusion 62 of the plastic layer 61 is fitted into the second through hole 11 of the movable contact piece 1, and the movable contact piece 1 is secured to the yoke 2.

In this embodiment, during the injection molding, the plastic protrusion 62 is formed in the second through hole 11 of the movable contact piece 1, and a fixing portion 620 is formed on an bottom end of the plastic protrusion 62 protruding from the second through hole 11 of the movable contact piece 1 has a cross-sectional area larger than the second through hole 11 of the movable contact piece 1, to cover the body of the movable contact piece around the second through hole 11 of the movable contact piece 1 wholly or partially by means of the fixing portion 620, such that the movable contact piece 1 is fixedly connected to the yoke 2. In this way, the plastic portions on both sides of the yoke 2 can be stabilized but not moved.

Plastic gates of a mold when being injected may be located on one or more plastic protrusions 62 or on the plastic side facing to the coil 3. In this embodiment, the plastic gate is located on the plastic protrusion 62, which is helpful for the injection molding and simplifying the mold structure and improving a yield.

The size of the second through hole 11 of the movable contact piece 1 and the size of the first through hole 23 of the corresponding yoke 2 may not be limited. If the injection gate is provided on the plastic protrusion 62, the second through hole 11 of the movable contact piece 1 is generally designed to be larger than the first through hole 23 of the yoke 2, because the second through hole 11 on the movable contact piece 1 facilitates for plastic flowing and reducing the difficulty of production due to injection molding.

Further, the movable contact piece 1 and the yoke 2 may be further fixed at a place where the movable contact piece 1 contacts with the yoke 2 in a laser welding manner, that is, a molten structure 12 formed by the laser welding is further provided at a place where the movable contact piece 1 contacts with the yoke 2, and the movable contact piece 1 and the yoke 2 are connected together by the molten structure 12.

In this embodiment, the molten structure is in a linear shape. Of course, the molten structure may also be a dotted shape. A plurality of dot-shaped molten structures is arranged in a straight line.

In the electromagnetic relay of the present disclosure, one side of the vertical edge 22 of the yoke 2 facing to the coil 3 is provided with the plastic layer 61 formed by means of the injection molding, such that the plastic layer 61 is provided between the yoke 2 and the coil 3 (the coil enamelled wire) in an insulating manner. One side of the plastic layer 61 facing away from the coil 3 is provided with a plastic protrusion 62 formed by the injection molding, such that the plastic protrusion 62 is secured to the movable contact piece 1. Such structure of the present disclosure, on the one hand, may improve the insulation performance of the yoke 2 and the coil 3 and ensure the position accuracy of the insulating component without affecting the winding space, and effectively reduce the assembling process; on the other hand, may secure the yoke to the movable contact piece by means of the plastic protrusion, the plastic layer and the first injection body, instead of the pressure riveting manner or a rotation riveting manner, when the yoke 2 is secured to the movable contact piece 1, such that a stress cannot generate to deform the movable contact piece, and improve the consistency of the size of the movable contact piece.

In the electromagnetic relay of the present disclosure, one side of the vertical edge of the yoke facing to the coil 3 is further provided with a groove 24, in which the plastic layer 61 is filled. This structure accommodates the plastic formed by means of injection molding by using the groove 24, which reduces or does not take up winding space while increasing the insulation distance. According to the present disclosure, the height of the plastic layer 61 is designed to exceed the size of the winding window of the bobbin of the coil in the vertical direction, which may achieve an effect of increasing the insulation distance.

An electromagnetic relay of the present disclosure includes a first through hole 23 corresponding to a plastic protrusion 62 on a vertical edge 22 of the yoke 2. The first through hole 23 is filled with a first plastic body formed in an injection molding manner. The first plastic body is integrally connected between a plastic layer 61 and the plastic protrusion 62. The structure allows the plastic to be attached to the yoke 2 in an insertion molding manner without assembling, to reduce the additional positional dispersion caused by assembling and improve consistency of the insulation distance. According to the present disclosure, the plastic protrusion 62 is formed in a second through hole 11 of a movable contact piece in the injection molding manner, and the plastic protrusion protruding out of the second through hole of the movable contact piece has a cross-sectional area larger than that of the second through hole 11 of the movable contact piece 1. The protrusion 62 of the present disclosure is formed by a molten injection molding, after being cooled, the movable contact piece 1 is pressed against the back of the yoke 2, such that a reliable fixation is formed. The plastic is in a molten state to be matched with the through hole of the movable contact piece, at a smaller area, so that an extra stress may not be brought for the movable contact piece during cooling, which does not cause stress deformation of the movable contact piece easily and may improve the consistency of the movable contact piece.

According to the electromagnetic relay of the present disclosure, the movable contact piece 1 is integrally connected to the yoke 2 in a laser welding manner at a point where the movable contact piece 1 is in contact with the yoke 2. Such structure may further improve positioning security of the movable contact piece and improve heat dissipation effect of the movable contact piece. The laser welding may melt local metal at a laser irradiation of movable contact piece 1 and the yoke 2. The movable contact piece 1 and the yoke 2 are integrally formed by the molten metal, and the heat of the movable contact piece 1 may be quickly radiated by the yoke 2 through a molten joint.

The Second Embodiment

Figure 11:
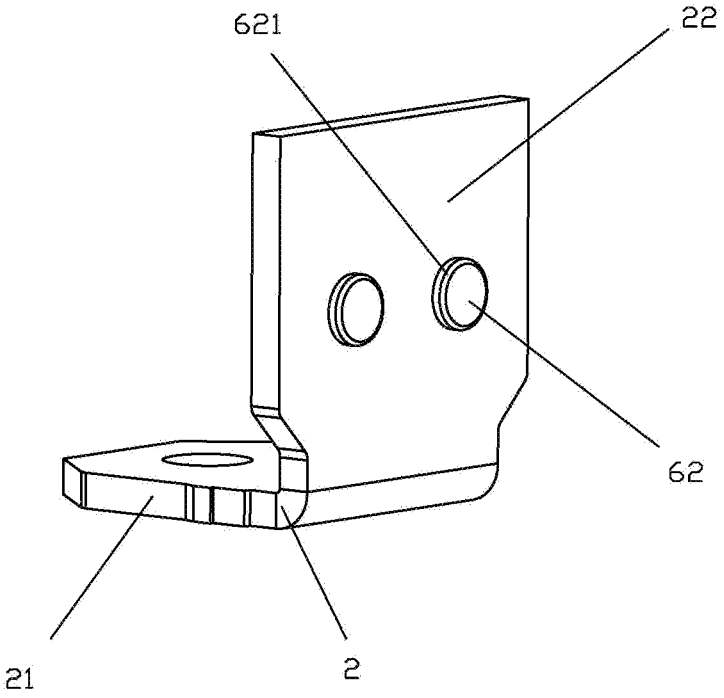
FIG. 11 is a schematic perspective view of the yoke in a second implementation of the electromagnetic relay of the present disclosure.
Figure 12:
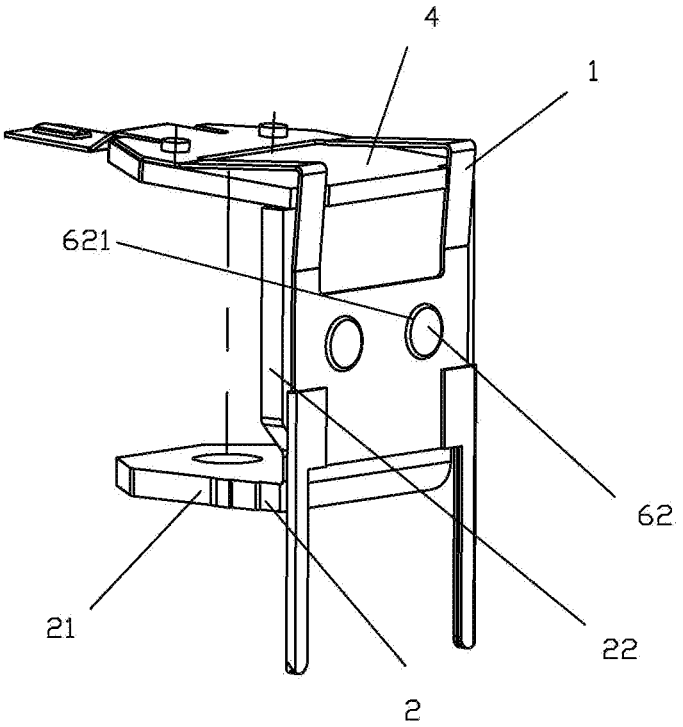
FIG. 12 is a schematic perspective view of the yoke shown in FIG. 11 and the movable contact piece armature assembly being assembled by means of a hot riveting manner.
Figure 13:
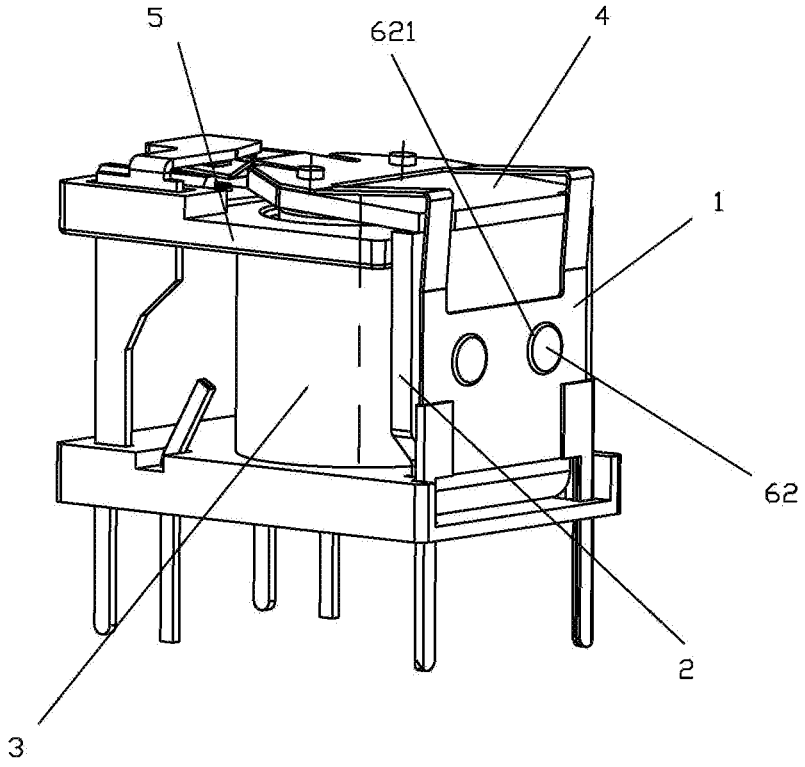
FIG. 13 is a schematic perspective view of the second implementation of the electromagnetic relay of the present disclosure.

Referring to FIG. 11 to FIG. 13, the second embodiment of the electromagnetic relay of the present disclosure, in comparison with the first embodiment, mainly has following difference: the movable contact piece is fixedly connected to the yoke in different manners. In the second embodiment, the movable contact piece 1 is fixed to the yoke 2 by inserting the plastic protrusion 62 molded on the yoke into the second through hole 11 of the movable contact piece 1, at this time, the second through hole 11 of the movable contact piece 1 plays a positioning function, because the through hole may form a gap fit to the protrusion 62 molded in the first through hole 23 of the yoke, and then, the plastic protrusion protruding from the second through hole 11 of the movable contact piece 1 is treated in a hot-riveting manner, such that the plastic protrusion is deformed to extend outwardly to form an extending portion 621. The extending portion 621 wholly or partially covers the body of the movable contact piece around the second through hole 11 of the movable contact piece 1, such that the movable contact piece 1 is fixedly connected to the yoke 2.

In the second embodiment of the electromagnetic relay of the present disclosure, the plastic protrusion 62 molded on the yoke 2 is inserted into the second through hole 11 of the movable contact piece, and the extending portion 621 is formed by hot-riveting the plastic protrusion protruding from the second through hole 11 of the movable contact piece 1, such that the yoke 2 is fixedly connected to the movable contact piece 1. The hot riveting as described in the present disclosure is presented as that the plastic protrusion 62 is melted at a high temperature, flows into the place, and then cooled to be solidified. The melted plastic does not generate stress for the movable contact piece 1, and the plastic protrusion 62 and movable contact piece 1 have a smaller matching area, so that the movable contact piece 1 may not be deformed and improve the dimensional consistency of movable contact piece 1.

Compared with the prior art, the electromagnetic relay of the present disclosure has following advantageous effects:

1. One side of the vertical edge of the yoke facing to the coil is provided with a plastic layer is formed by means of injection molding, such that the plastic layer is provided between the yoke and the coil in an insulating manner, and one side facing away from the coil is provided with the plastic protrusion formed by means of injection molding, the plastic protrusion is fixed to the movable contact piece. The structure of the present disclosure, on one hand, may improve insulation of the yoke and the coil, ensure the positional accuracy of the insulating components, and effectively reduce the assembling process, without affecting the winding space; on the other hand, may not cause stress to deform the movable contact piece and improve the dimensional consistency of the movable contact piece, when the yoke is fixed to the movable contact piece, by the way that the yoke and the movable contact piece are fixed by the plastic protrusion, the plastic layer and the first injection body, instead of the existing pressure riveting or rotational riveting way by which the yoke is fixed to the movable contact piece.

2. One side facing to the coil in the vertical edge of the yoke is further provided with a groove, in which the plastic layer is filled. This structure accommodates the plastic formed by injection molding by using the groove, which reduces or does not take up the winding space when the insulation distance is increased.

3. The height size of the plastic layer is designed to exceed the size of winding window of the bobbin of the coil in the vertical direction, which may play an effect of increasing the insulation distance.

4. The vertical edge of the yoke is provided with a first through hole corresponding to the plastic protrusion. The first plastic body formed by means of the injection molding is filled in the first through hole, and is integrally connected between the plastic layer and the plastic protrusion. The structure allows the plastic to be attached to the yoke in an insertion molding manner without assembling, which may reduce the additional positional dispersion caused by assembling and improve the consistency of the insulation distance.

5. The plastic protrusion is formed in the second through hole of the movable contact piece in an injection molding manner, and the plastic protrusion protruding from the second through hole of the movable contact piece has a cross-sectional area larger than that of the second through hole of the movable contact piece. The protrusion of the present disclosure is formed in a molten injection molding manner, after being cooled, the movable contact piece is pressed against the back of the yoke, such that a reliable fixation is formed. The plastic is in a molten state to be matched with the through hole of the movable contact piece at a smaller area, so that an extra stress may not be brought for the movable contact piece during cooling, which does not cause stress deformation of the movable contact piece easily and may improve the consistency of the movable contact piece.

6. The plastic protrusion molded on the yoke is inserted into the second through hole of the movable contact piece, and the plastic protrusion is deformed by hot-riveting the plastic protrusion protruding from the second through hole of the movable contact piece. The hot riveting of the present disclosure is presented as that the plastic protrusion is melted at a high temperature, flows into the place, and then cooled to be solidified. The melted plastic does not generate stress for the movable contact piece, and the plastic protrusion and movable contact piece have a smaller matching area, so that the movable contact piece may not be deformed and improve the dimensional consistency of movable contact piece.

7. The movable contact piece is integrally connected to the yoke in a laser welding manner at a point where the movable contact piece is in contact with the yoke. Such structure may further improve positioning security of the movable contact piece and improve heat dissipation effect of the movable contact piece.

8. A plastic gate of the plastic layer, the plastic protrusion and the first plastic body during injection molding may be located on the side of the plastic layer facing to the coil or on the plastic protrusion, preferably on the plastic protrusion. This structure is helpful for injection molding and simplifies the mold structure and increases yield.

INDUSTRIAL APPLICABILITY

In the present disclosure, one side of the vertical edge of the yoke facing to the coil is provided with a plastic layer formed by means of injection molding, such that the plastic layer is provided between the yoke and the coil in an insulating manner; and one side facing away from the coil is provided with the plastic protrusion formed by means of injection molding, such that the plastic protrusion is fixed to the movable contact piece. The structure of the present disclosure, on one hand, may improve insulation of the yoke and the coil, ensure the positional accuracy of the insulating components, and effectively reduce the assembling process, without affecting the winding space; on the other hand, may not cause stress to deform the movable contact piece and improve the dimensional consistency of the movable contact piece, when the yoke is fixed to the movable contact piece, by the way that the yoke and the movable contact piece are fixed by the plastic protrusion, the plastic layer and the first injection body, instead of the existing pressure riveting or rotational riveting way by which the yoke is fixed to the movable contact piece.

Although the present disclosure has been described with reference to a few of exemplary embodiments, it should be understood that all the terms used are illustrative and exemplary, and nonrestrictive. As the present disclosure may be embodied in a variety of forms without departing from the spirit or scope of the invention, it is to be understood that the above-described embodiments are not limited to any foregoing detail. All changes and modifications within the scope of the claims or their equivalents are intended to be embraced by the appended claims.

What is claimed is:

1. An electromagnetic relay, comprising a movable contact piece;

a coil, the coil being provided with an iron core; and a yoke, the yoke is L-shaped, and has a horizontal edge and a vertical edge, the yoke is disposed outside the coil, and the horizontal edge of the yoke is fixedly connected to the bottom of the iron core, and the vertical edge of the yoke is parallel to an axis of the iron core, wherein one side of the vertical edge of the yoke facing to the coil is provided with a plastic layer formed by means of injection molding, the plastic layer is provided between the yoke and the coil in an insulating manner;

wherein one side of the vertical edge of the yoke facing away from the coil is provided with a plastic protrusion formed by means of the injection molding, the plastic protrusion is fixedly connected to the movable contact piece, wherein the vertical edge of the yoke is provided with a first through hole corresponding to the plastic protrusion, and the first through hole is provided with a first plastic body formed by means of the injection molding.

2. The electromagnetic relay according to claim 1, wherein a plastic gate of the plastic layer, the plastic protrusion and the plastic body during injection molding is located on the plastic protrusion.

3. The electromagnetic relay according to claim 1, wherein a shape of the first through hole of the yoke is a circle, a square, a triangle, an ellipse or a rectangle.

4. The electromagnetic relay according to claim 1, wherein one side of the vertical edge of the yoke facing to the coil is further provided with a groove, into which the plastic layer is filled.

5. The electromagnetic relay according to claim 4, wherein one side of the plastic layer facing the coil is flush with one side of the vertical edge of the yoke facing the coil.

6. The electromagnetic relay according to claim 4, wherein one side of the plastic layer facing to the coil protrudes from one side of the vertical edge of the yoke facing to the coil no more than 0.4 mm.

7. The electromagnetic relay according to claim 1, wherein one side of the plastic layer facing to the coil protrudes from one side of the vertical edge of the yoke facing to the coil no more than 0.4 mm.

8. The electromagnetic relay according to claim 1, wherein a height of the plastic layer exceeds a size of a winding window of a bobbin of the coil in a vertical direction.

9. The electromagnetic relay according to claim 1, wherein the movable contact piece is provided with a second through hole corresponding to the first through hole of the yoke, and the plastic protrusion of the yoke is fitted into the second through hole of the movable contact piece such that the movable contact piece is fixedly connected to the yoke.

10. The electromagnetic relay according to claim 9, wherein the plastic protrusion is formed by means of the injection molding and protrudes from the second through hole of the movable contact piece; and a fixing portion is formed on an bottom end of the plastic protrusion protruding from the second through hole of the movable contact piece, and the fixing portion has a cross-sectional area larger than the second through hole of the movable contact piece, to wholly or partially cover the movable contact piece around the second through hole of the movable contact piece, such that the movable contact piece is fixedly connected to the yoke.

11. The electromagnetic relay according to claim 9, wherein the plastic protrusion is inserted into and protruded from the second through hole of the movable contact piece, by hot-riveting the plastic protrusion protruding from the second through hole of the movable contact piece, the plastic protrusion is deformed to extend outwardly to form an extending portion, and the extending portion completely or partially covers the movable contact piece around the second through hole of the movable contact piece, to fix the movable contact piece and the yoke.

12. The electromagnetic relay according to claim 1, wherein a molten structure formed by a laser welding is further provided at a point where the movable contact piece is in contact with the yoke, and the movable contact piece is integrally connected to the yoke by means of the molten structure.

13. The electromagnetic relay according to claim 12, wherein the molten structure is dot-shaped, and a plurality of dot-shaped molten structures are arranged in a straight line.

14. The electromagnetic relay according to claim 12, wherein the molten structure is in a linear shape.

* * * * *